US005358232A

United States Patent [19]

Arendes et al.

[11] Patent Number: 5,358,232

[45] Date of Patent: Oct. 25, 1994

[54] METHOD AND DEVICE FOR PRODUCING DEFINED STACKS OF FOLDED OR UNFOLDED SHEETS

[75] Inventors: Bernd Arendes, Erkrath; Karl Hallwas, Langenfeld; Klaus Kirsch, Nohen, all of Fed. Rep. of Germany; Johannes Lieverdink, Zelhem, Netherlands; Manfred Zindorf, Langenfeld, Fed. Rep. of Germany

[73] Assignee: Bielomatik Leuze GmbH + Co., Neuffen, Fed. Rep. of Germany

[21] Appl. No.: 11,529

[22] Filed: Jan. 29, 1993

[30] Foreign Application Priority Data

Jan. 30, 1992 [DE] Fed. Rep. of Germany ..... 4202540

[51] Int. Cl.[5] ..... B65H 31/06

[52] U.S. Cl. ..... 271/181; 271/214; 414/798.7; 414/907

[58] Field of Search ..... 271/181, 214, 215, 314; 414/798.7, 907; 198/419.2, 419.3

[56] References Cited

U.S. PATENT DOCUMENTS

| | | | |
|---|---|---|---|
| 2,815,950 | 12/1957 | Kramer . | |
| 3,866,905 | 2/1975 | Trogan et al. . | |
| 4,611,705 | 9/1986 | Fluck | 198/419.3 X |
| 4,708,568 | 11/1987 | Odorici | 414/798.7 |
| 4,772,003 | 9/1988 | Nobuta | 271/181 X |

FOREIGN PATENT DOCUMENTS

| | | | |
|---|---|---|---|
| 0340494 | 11/1989 | European Pat. Off. . | |
| 0384255 | 8/1990 | European Pat. Off. . | |
| 1118688 | 4/1959 | Fed. Rep. of Germany . | |
| 2033326 | 2/1971 | Fed. Rep. of Germany . | |
| 2732837 | 7/1977 | Fed. Rep. of Germany . | |
| 3423479 | 6/1984 | Fed. Rep. of Germany . | |
| 3616470 | 5/1986 | Fed. Rep. of Germany . | |
| 3638197 | 6/1987 | Fed. Rep. of Germany . | |
| 36066 | 2/1984 | Japan | 271/181 |
| 1-231761 | 9/1989 | Japan . | |
| 607979 | 12/1978 | Switzerland . | |
| 9221599 | 12/1992 | World Int. Prop. O. . | |

*Primary Examiner*—Richard A. Schacher
*Attorney, Agent, or Firm*—Robert W. Becker & Associates

[57] ABSTRACT

The method and the device serves for the production of defined stacks of folded or unfolded sheets. The individually supplied sheets are placed on edge onto a horizontal table whereby the separation of the individual stacks is achieved by a separating support that is advanced parallel to the table at the stack forming velocity. In order to be able to separate and individualize product stacks of differently sized sheets without the need for structural adaptation of the device, the formation of a first separating plane defining the beginning of the stack as well as the formation of a second separating plane defining the end of the stack is achieved by a separating support that is insertable between the sheets in a direction transverse to the longitudinal extension of the table. Further supports are completely insertable into the thus formed separating planes. Optionally, a transferring support can be used intermediately which takes over the separating plane from the separating support and transfers the separating plane to the two further supports.

21 Claims, 7 Drawing Sheets

METHOD AND DEVICE FOR PRODUCING DEFINED STACKS OF FOLDED OR UNFOLDED SHEETS

BACKGROUND OF THE INVENTION

The present invention relates to a method for producing defined stacks of folded or unfolded sheets or sheet-type objects in which the individually supplied sheets are placed on edge on a horizontal surface and in which the separation into individual stacks is achieved by a separating support which is advanced at the stack forming velocity parallel to the horizontal surface.

A method for producing defined stacks of the aforementioned kind is known from German patent 27 32 837. The formation of stacks from individual sheets is achieved by a plurality of separating supports connected to a continuously circulating chain belt and the insertion of the separating supports into the plane of the stacks takes place within the area of the return of the chain belt. As soon as a stack of sheets supported at the previous separating support has reached the desired size, the following separating support located directly behind the return point of the chain belt is accelerated for a short period of time by a piston-spring unit which is prestressed until this separating support contacts the backside of the formed stack and thereby defines the rearward separating plane. This known method has the disadvantage that the separating supports must be spaced at an identical distance relative to one another so that thereby adaptations with respect to the desired length or size of the product stack are possible only with substantial remodifications. A size adaptation with respect to the height and width of the sheets also requires respective adjustments and adaptations at all of the separating supports. It is furthermore disadvantageous that with the known method only a separation into individual product stacks is possible; however, an individualization of the previously separated product stacks for further manufacturing steps is not possible.

It is therefore an object of the present invention to provide a method for producing defined stacks of folded or unfolded sheets or sheet-type objects which without any adaptation allows for a separation and subsequent individualization of product stacks even if they have different sizes.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
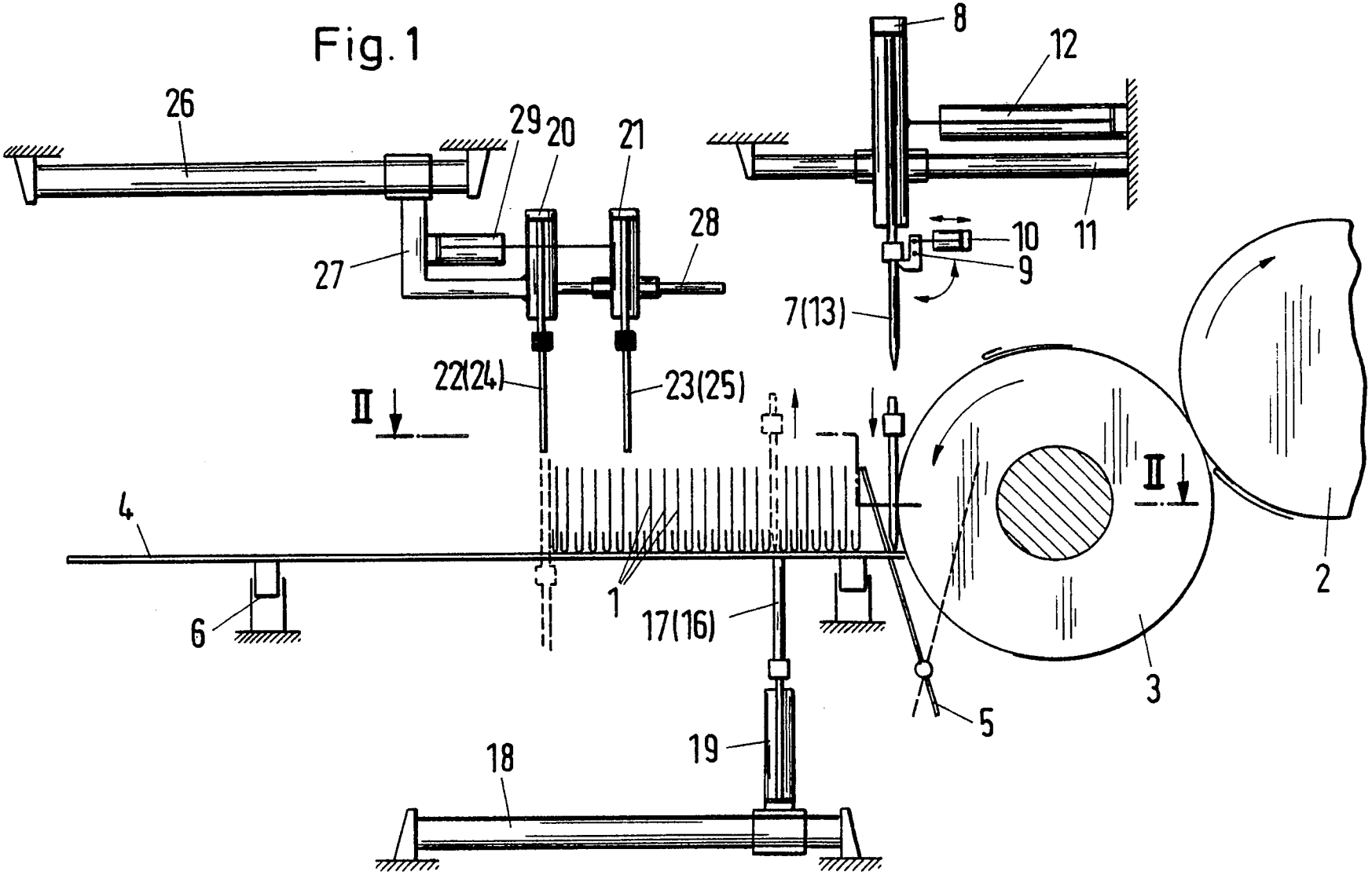
FIG. 1 is a schematic representation of a device for producing defined stacks of folded or unfolded sheets.

The method for producing defined stacks of folded and unfolded sheets or sheet-type objects according to the present invention is primarily characterized by the steps of:

Individually feeding sheets to a horizontal surface;

Placing each sheet on edge onto the horizontal surface;

Separating the sheets into individual stacks with a separating support by forming a first separating plane defining the beginning of the stack and forming a second separating plane defining the end of the stack by sequentially inserting the separating support transverse to the longitudinal extension of the horizontal surface between the sheets placed on edge on the horizontal surface;

Advancing the separating support parallel to the horizontal surface at the stack forming velocity; and Introducing at the first separating plane a first support and at the second separating plane a second support.

It is thus suggested that the formation of a first separating plane defining the beginning of the stack and the formation of a second separation plane defining the end of the stack is achieved by inserting transverse to the longitudinal extension of the horizontal surface in sequence the separating support between the sheets and by inserting into the thus formed separating planes a further support.

Since the inventive method operates with only one separating support, adaptations with respect to the length of the product stack do not require any structural alterations. The length of the product stack is instead determined by selecting the point of time at which the separating support is inserted between the sheets for the second time in order to define the second separating plane. It is furthermore advantageous that with the aid of the two further supports the separated product stack can be individualized and conveyed to a subsequent manufacturing operation.

In a further embodiment of the present method it is suggested that the separating support is introduced between the sheets with a pre-stressed device. With this measure it is possible to introduce the separating support between the sheets at a high speed in order to form the separating planes and to thereby achieve a reliable separation of two product stacks.

Preferably, this is achieved by providing the further step of releasing the pre-stressed device by activating a locking pawl.

In order to produce the required stack density necessary for further manufacturing steps or especially for packaging the product stack it is suggested in a further embodiment of the present invention that, after insertion of the two further supports between the sheets, the second support defining the separating plane at the end of the stack is advanced at a greater velocity parallel to the horizontal surface than the first support defining the separating plane for the beginning of the stack.

In another embodiment of the present invention it is provided that a transferring support is introduced at the first separating plane and subsequently at the second separating plane before introducing the first and the second supports in order to maintain the separating plane. With this measure, the method provides for a greater time period for the further handling of the product stack to be received and transported by the two further supports.

In order to achieve a continuous and thus gentle handling of the products, the insertion of the transferring support takes place while advancing the separating support and the transferring support at the stack forming velocity parallel to the horizontal surface. The insertion of the two further supports also takes place while advancing of the transferring support and the further supports at the stack forming velocity parallel to the horizontal surface.

In a further embodiment of the present invention it is provided that the separating support, the transferring support, and the further supports are moved with the aid of operating cylinders.

The present invention further relates to a device for producing defined stacks of folded or unfolded sheets or sheet-type objects, the device comprising a feeding device for individually feeding sheets to a horizontal surface such as a table and placing the sheets on edge onto the horizontal table surface, and further comprising a separating support advancing in the longitudinal direction of the horizontal table surface for forming defined separating planes between individual sheets to form the individual stacks.

The inventive device for producing defined stacks of folded and unfolded sheets or sheet-type objects is primarily characterized by:

A horizontal table;

A feeding device for individually feeding sheets to the horizontal table and placing the sheets on edge onto the horizontal table;

A separating support displaceable in a longitudinal direction of the horizontal table for separating the sheets into individual stacks, the separating support vertically movable for complete insertion between the sheets; and At least two further supports independently displaceable relative to the separating support in the longitudinal direction of the horizontal table, the further supports vertically movable for complete insertion between the sheets.

Preferably, the further supports comprise a relative guide for horizontally moving the further supports relative to one another. Advantageously, the device further comprises a common horizontal guide to which the further supports together with the relative guide are slidably connected.

In a further embodiment of the present invention, the device further comprises a pressure cylinder with a piston, the piston connected to the separating support. The separating support preferably comprises a locking pawl for locking the separating support in its initial position. It is further suggested that in addition to the separating support and the two further supports a transferring support is provided that is displaceable in the longitudinal direction of the horizontal table and completely insertable between the sheets in a vertical direction. This transferring support provides for a greater time independence between the movement of the separating support and the movement of the two further supports initiating the further transport of the product stack.

With respect to a spacial separation of the individual movements it is advantageous when the transferring support is arranged on a side of the horizontal table that is opposite to the side where the separating support and the further supports are positioned.

For realizing the individual movements it is furthermore suggested that the table is provided with a plurality of slots extending in the longitudinal direction with longitudinal tracks therebetween forming the table surface. The separating support, the further support, and the transferring support each are preferably in the form of a rake with a plurality of parallel fingers. The fingers of the further supports and the transferring support are preferably arranged within the area of the slots, i.e., above or below the slots, and the fingers of the separating support are preferably arranged within the area of the tracks of the horizontal table, i.e., above or below the tracks. In order to be able to separate the further supports from the transferring support in a reliable manner when the further supports are completely inserted between the sheets, in one embodiment of the present invention the fingers of the transferring support have a U-shaped cross-section with their open side facing the feeding device.

Expediently, the device further comprises an operating cylinder connected to the transferring support for displacing the transferring support in the longitudinal direction of the horizontal table.

In a further development of the present invention, the horizontal table comprises adjusting elements for adjusting the height of the table. It is furthermore expedient that the device comprises adjusting members for adjusting the width of the horizontal table, of the separating support, of the transferring support, and of the further supports. These adjusting elements and adjusting members allow for the use of the present invention with various sizes of sheets.

Preferably, the device further comprises an operating cylinder connected to the separating support for displacing the separating support in the longitudinal direction of the horizontal table.

DESCRIPTION OF PREFERRED EMBODIMENTS

The present invention will now be described in detail with the aid of several specific embodiments utilizing FIGS. 1 through 4.

The device represented in FIGS. 1 and 2 assembles sheets 1, respectively sheet-type objects, such as napkins, to stacks and transports the stacks subsequently to a further manufacturing device arranged downstream, for example, to a packaging machine. The finished cut and folded sheets 1 are supplied by a cylindrical-transfer unit 2 to a feeding device 3 in the form of a placing cylinder which places the individual sheets 1 on a horizontal surface in the form of a table 4. The sheets 1 which are held at the feeding device 3 by gripping devices, not represented in the drawing, are removed from the feeding device 3 just before reaching the table 4 and are moved subsequently by a pivotable beater 5 against the already formed stack at the horizontal table 4. The newly added sheet is positioned at the rear of the already formed stack. In order to provide the required freedom of movement to the beater 5, the feeding device 3 is comprised of individual spaced apart disks and the beater 5 engages in the manner of a rake the slots between the individual disks as can be seen in FIG. 2. After positioning the last sheet at the rear of the stack, the beater 5 is returned into its initial position indicated in a dash-dotted line and remains in this position until the following sheet, held at the circumference of the feeding device 3 has reached approximately the height of the table 4.

In order to be able to adapt the height of the table 4 to different sized sheets 1, suitable adjusting elements 6 are provided.

Figure 2:
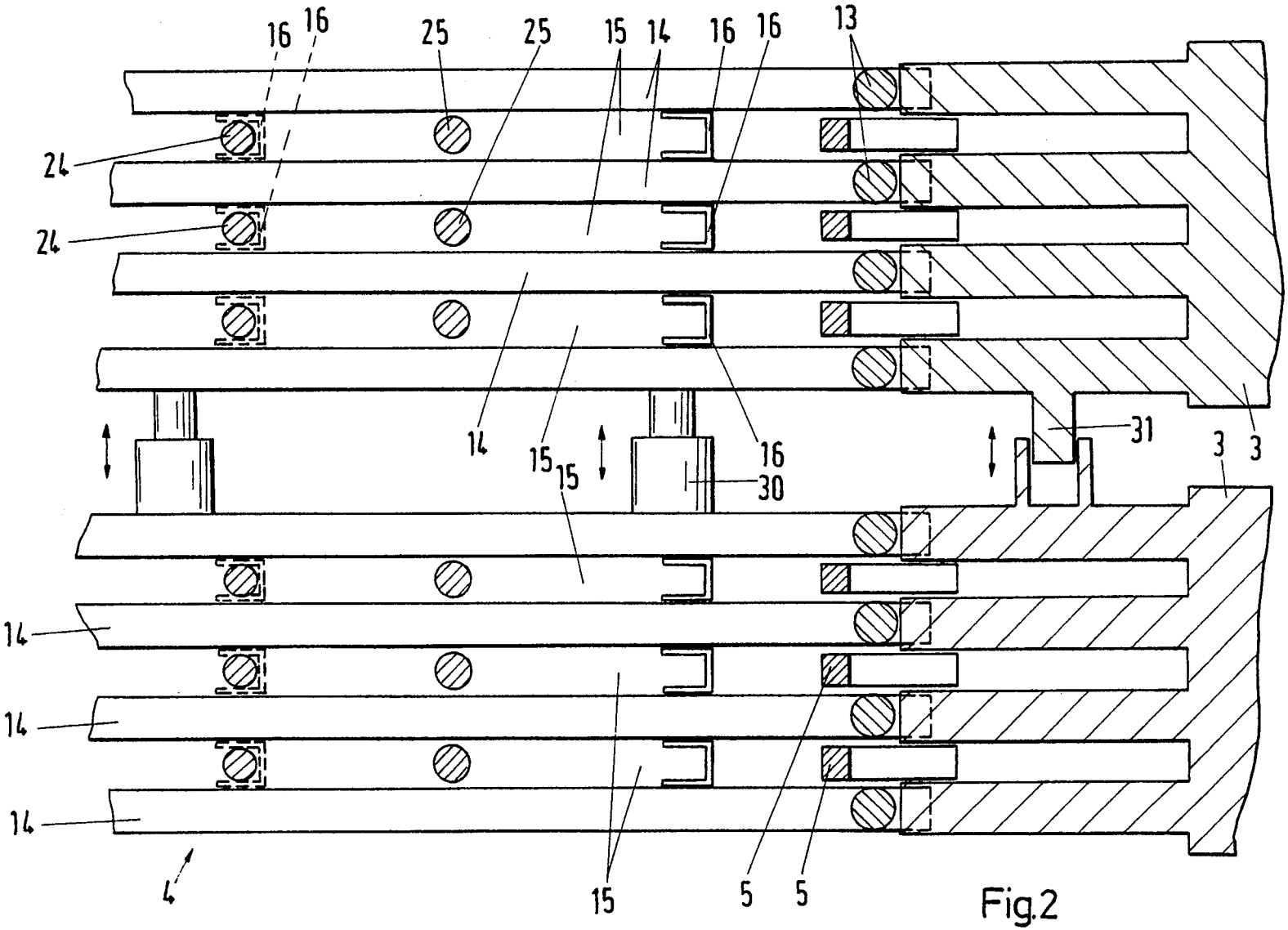
FIG. 2 is a view of the device in the plane II—II of FIG. 1 without representation of individual sheets; the method for forming defined stacks of folded or unfolded sheets.

Above the pivoting area of the beater 5 a separating support 7 in the form of a rake or a comb is arranged which can be moved by a pressure cylinder 8 into a position directly above the top side of the table 4 and which can be reciprocated into the initial position indicated in FIG. 1. In this initial position the separating support 7 is locked by a locking pawl 9 operating in the form of a catch. The actuation of the locking pawl 9 resulting in the release of the separating support 7 is initiated by a small pressure cylinder 10. Via a horizontal guide 11 and a corresponding operating cylinder 12 a controlled movement of the separating support 7 parallel to the longitudinal extension of the table 4 is possible. FIG. 2 shows that the individual fingers 13 of the separating support 7 in the form of a rake are arranged in the same longitudinal plane as the individual disks of the cylindrical feeding device 3. In the same longitudinal plane narrow tracks 14 are provided which together form the table 4 and are separated by slots 15. Within the forward portions of the slots 15 of the table 4 the tips of the beater 5 are movable.

Below the slots 15 of the table 4 the individual fingers 16 of the transferring support 17, also embodied in the form of a rake or a comb, are positioned. FIG. 2 also shows that the individual fingers 16 of the transferring support 17 have a U-shaped cross-section, with their open side facing the feeding device 3. The transferring support 17 is also displaceable in the longitudinal direction by a horizontal guide 18. With the aid of a vertical operating cylinder 19 the transferring support 17 can be displaced from the position shown in FIG. 1 below the table 4 to the left into an upper position shown in a dash-dotted line. In this upper position the transferring support 17 is inserted between the sheets, i.e., between two stacks.

FIG. 1 further shows that above the table 4 two further supports 22, 23 are arranged which are displaceable by vertically acting operating cylinders 20, 21. The two further supports 22, 23 can be displaced from their upper position represented in FIG. 1 into a lower position which is directly above the table 4. In the left portion of FIG. 2 it is shown that the two further supports 22, 23 in this lower position in which they are inserted between two stacks, their fingers 24, 25 engage exactly the U-shaped cross-section of the fingers 16 of the transferring support 17. The fingers 16 of the transferring support 17 essentially enclose the fingers 24, 25 of the two further supports 22, 23.

The two supports 22, 23 are longitudinally displaceable via a common horizontal guide 26. Both supports 22, 23 are arranged on a support 27 which itself is provided with a small longitudinal relative guide 28. While the operating cylinder 20 of the forward support 22 is fixedly connected to the support 27, the operating cylinder 21 of the rearward support 23 is adjustable relative to the support 27 by a longitudinal guide 28. For this purpose a further smaller operating cylinder 29 is provided. With such an arrangement the forward support 22 and the rearward support 23 are displaceable in the vertical as well as in the horizontal direction independent from one another.

FIG. 2 shows that the width of the table 4 and of the feeding device 3 can be adjusted with suitable adjusting elements 30, 31 in order to allow for an adaptation to the width of various sizes of sheets. The beater 5, the separating support 7, the transferring support 17, and the supports 22, 23 are also provided with respective adjusting members.

The function of the device will be described in the following with the aid of FIGS. 3*a* to 3*h*.

Figure 3A:
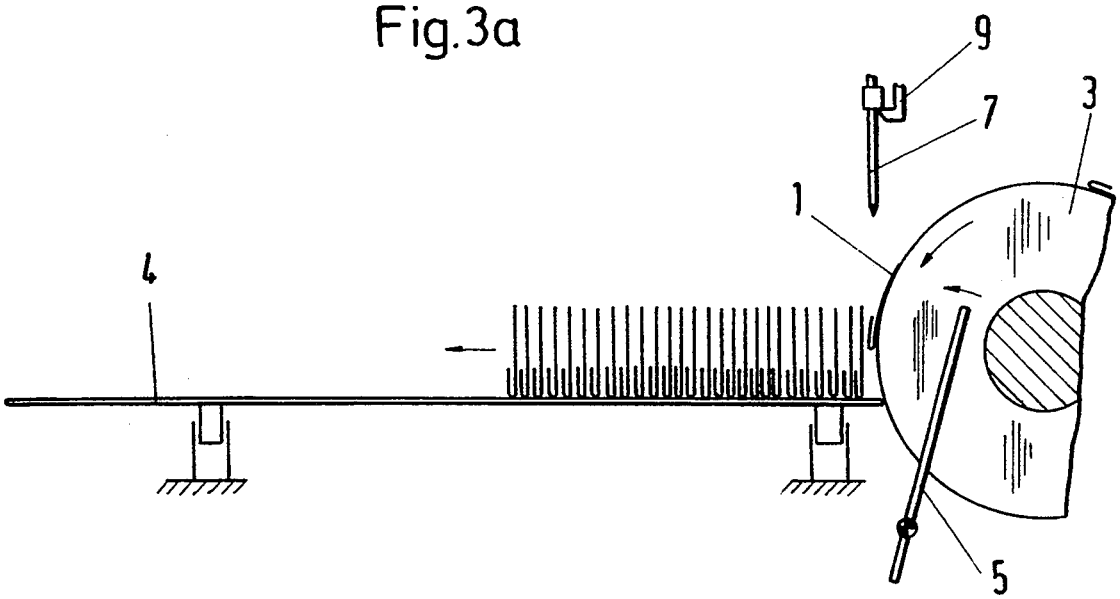
Figure 3B:
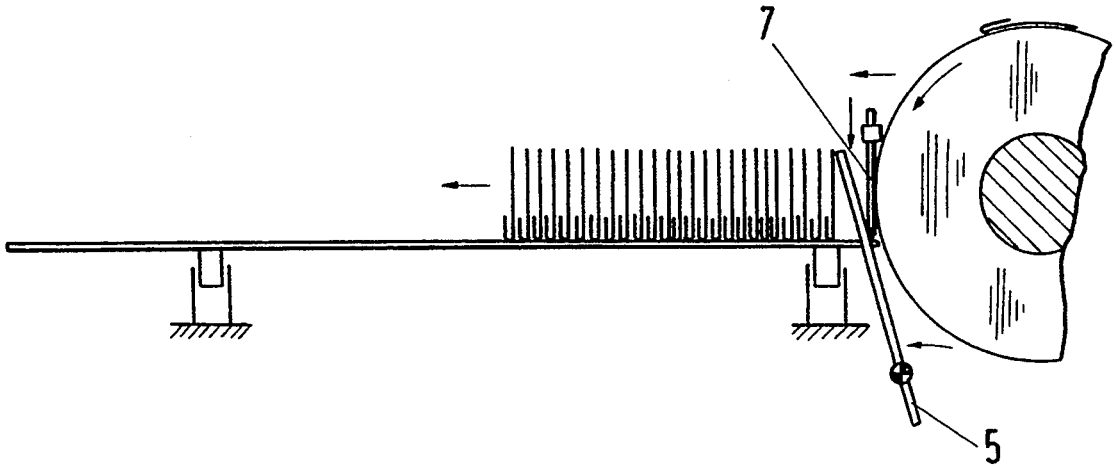

In the initial position according to FIG. 3*a* the separating support 7 is in its locked position above the already formed stack of sheets 1. In order to provide a sufficiently high initial speed to the separating support 7 upon release by the locking pawl 9, the pressure cylinder 8 for the vertical movement of the separating support 7 is already under working pressure. After at the desired point in time the beater 5 has pressed the last sheet against the already formed stack, the locking pawl 9 releases the separating support 7 so that the separating support 7 moves at a high speed to a position directly above the table 4, as is shown in FIG. 3*b*. As soon as the separating support 7 has reached its lower position, the separating support 7 is moved in the longitudinal direction of the table 4 until the pivoting area of the beater is again unobstructed. The subsequent further movement of the separating support 7 is carried out at the stack forming velocity, that is, at the velocity with which the sheets 1 placed on the surface of the table 4 are moved in the horizontal direction.

Figure 3C:
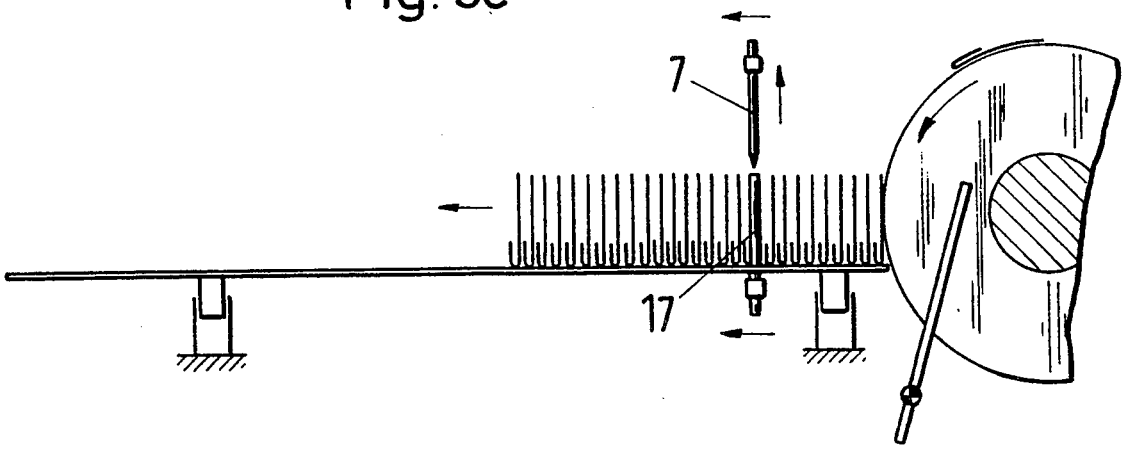

As soon as the separating support 7 has been moved away from the feeding device 3 by a certain amount at the stack forming velocity, the transferring support 17 is inserted from below into the thus formed separation plane whereby the fingers 16 of the transferring support 17 are engaged between fingers 13 of the separating support 7. As soon as the transferring support 17 has reached its upper position, the separating support 7 is moved in an upward direction as represented in FIG. 3*c* and returned into its initial position according to FIG. 3*a*. Thus, the transferring support 17 is introduced in this method step according to FIG. 3*c* into the separating plane which was initially formed by the separating support 7 and thereby takes over the task of separating the two adjacent stacks. During the transfer the separating support 7 and the transferring support 17 are moved at the same velocity, i.e., the stack forming velocity. Alternatively, the separating support 7 and the transferring support 17 can assume a fixed transferring position for a short period of time.

Figure 3D:
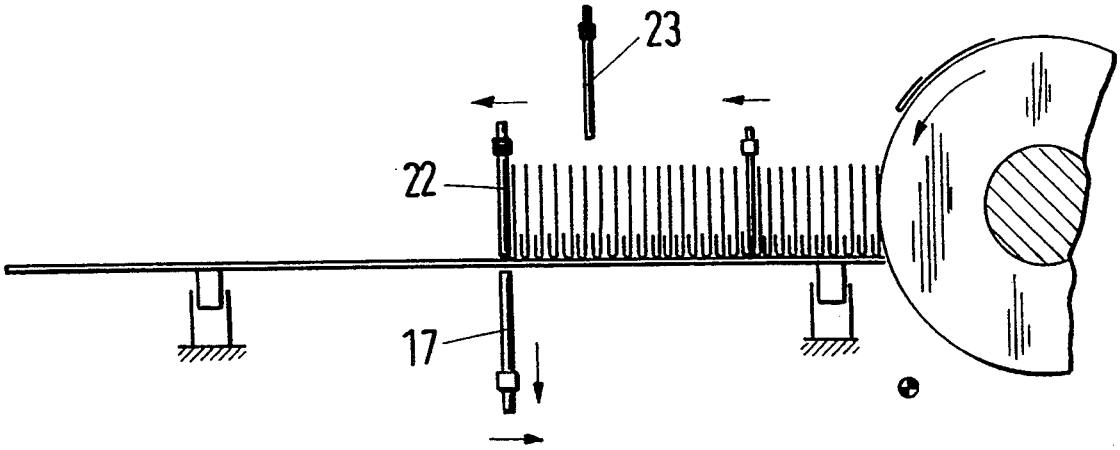

As soon as the continuously forwardly moved transferring support 17 has reached the position below the forward support 22, the forward support 22 is inserted from the top into the separating plane formed by the transferring support 17 whereby the individual fingers 24 of the support 22 engage the U-shaped cross-section of the fingers 16 of the transferring support 17. Only thereafter is the transferring support 17 removed in a downward direction and returned into its initial position. This stage is shown in FIG. 3*d*.

Figure 3E:
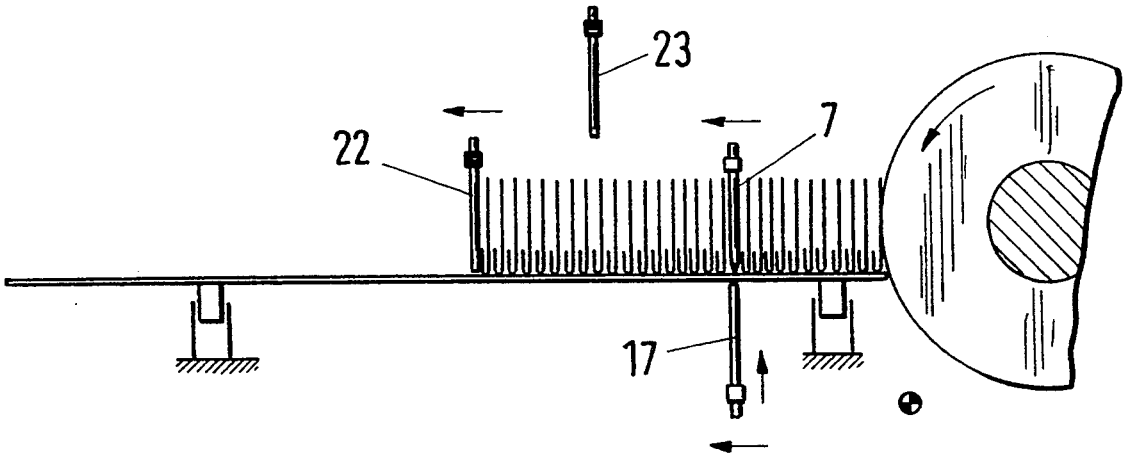
Figure 3F:
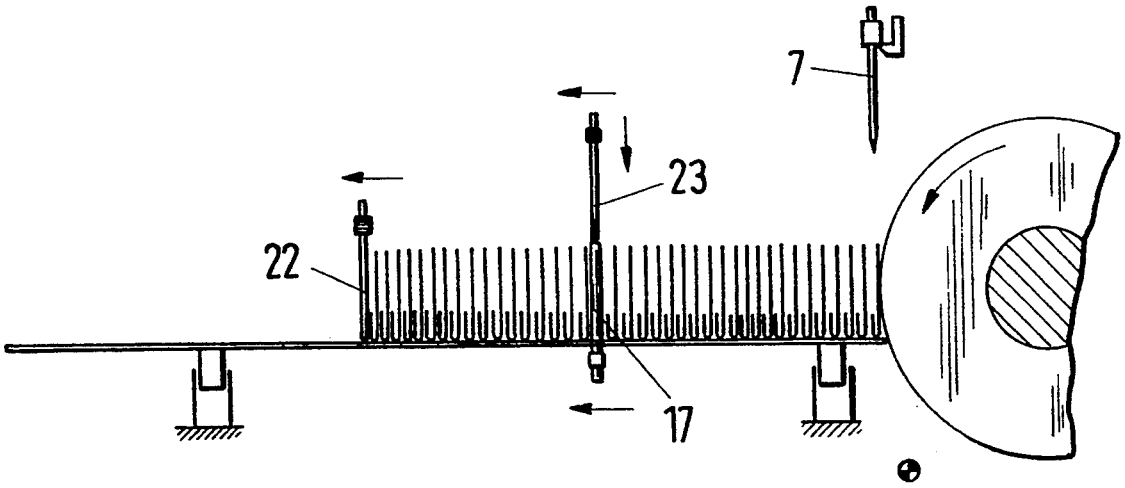

Subsequently, the transferring support 17 takes over the separating plane generated by the separating support 7, as shown in FIG. 3*e*. This second, respectively, rearward separating plane defines the end of the stack. Up to this point the rearward support 23 has not yet performed a longitudinal movement which has been prevented by a movement of the small operating cylinder 29 along the horizontal guide 26 opposite to the previously described movements. As soon as the transferring support 17 has reached the position shown in FIG. 3*f* bellow the support 23, the rearward support 23 is lowered and takes over the rearward separating plane from the transferring support 17. As described above for the transfer of the forward separating plane to the support 22, the transfer of the rearward separating plane to the support 23 is carried out while the support 23 and the transferring support 17 are moved at the same horizontal velocity. Alternatively, the two supports 17, 23 can assume a fixed transfer position for a short period of time.

Figure 3G:
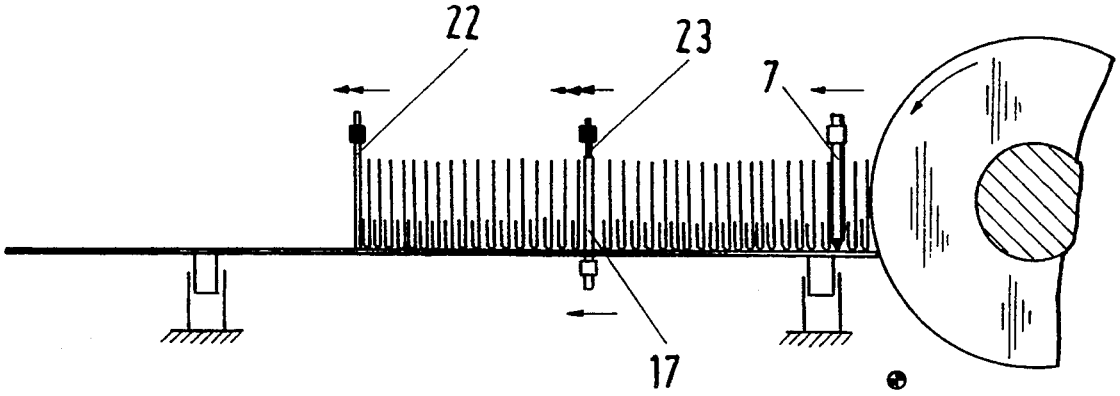
Figure 3H:
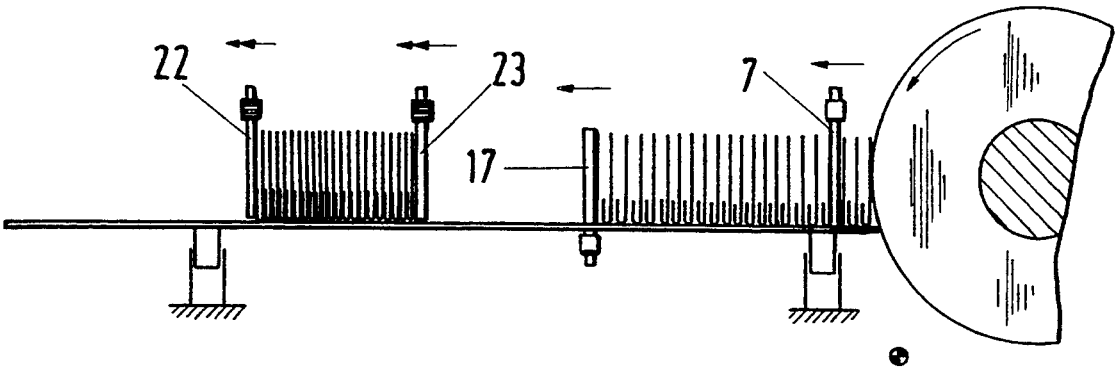

FIG. 3*g* shows the stage directly after transfer of the rearward separating plane to the rearward support 23. As soon as this transfer has been completed, the forward support 22 is advanced at a high speed and the rearward support 23 is advanced at an even higher velocity, while the transferring support 17 is advanced at the normal stack forming velocity. The advancing velocities are indicated with respective arrows in the FIGS. 3*g* and 3*h*. Due to the relative velocity of the two supports 22, 23 a compression of the length of the stack to the desired, respectively, required length needed for further manufacturing steps is achieved. As soon as the desired compression has been reached the thus individualized stack is advanced at a high speed. This is shown in FIG. 3*h*. The represented opening of the rearward separating plane is possible because the fingers 25 of the rearward support 23 can be removed without problems from the U-shaped fingers 16 of the transferring support 17. During the transport of the formed stack the transferring support 17 provides the forward abutment and defines the forward separating plane of the following stack. This adjacent forward separating plane is subsequently taken over by the returning forward support 22 so that the method is repeated beginning with the stage represented in FIG. 3*d*.

The separating planes are respectively formed by the separating support 7 advanced at a high velocity, are subsequently taken over by the transferring support 17, and are then transferred to one of the two supports 22, 23, respectively.

Figure 4:
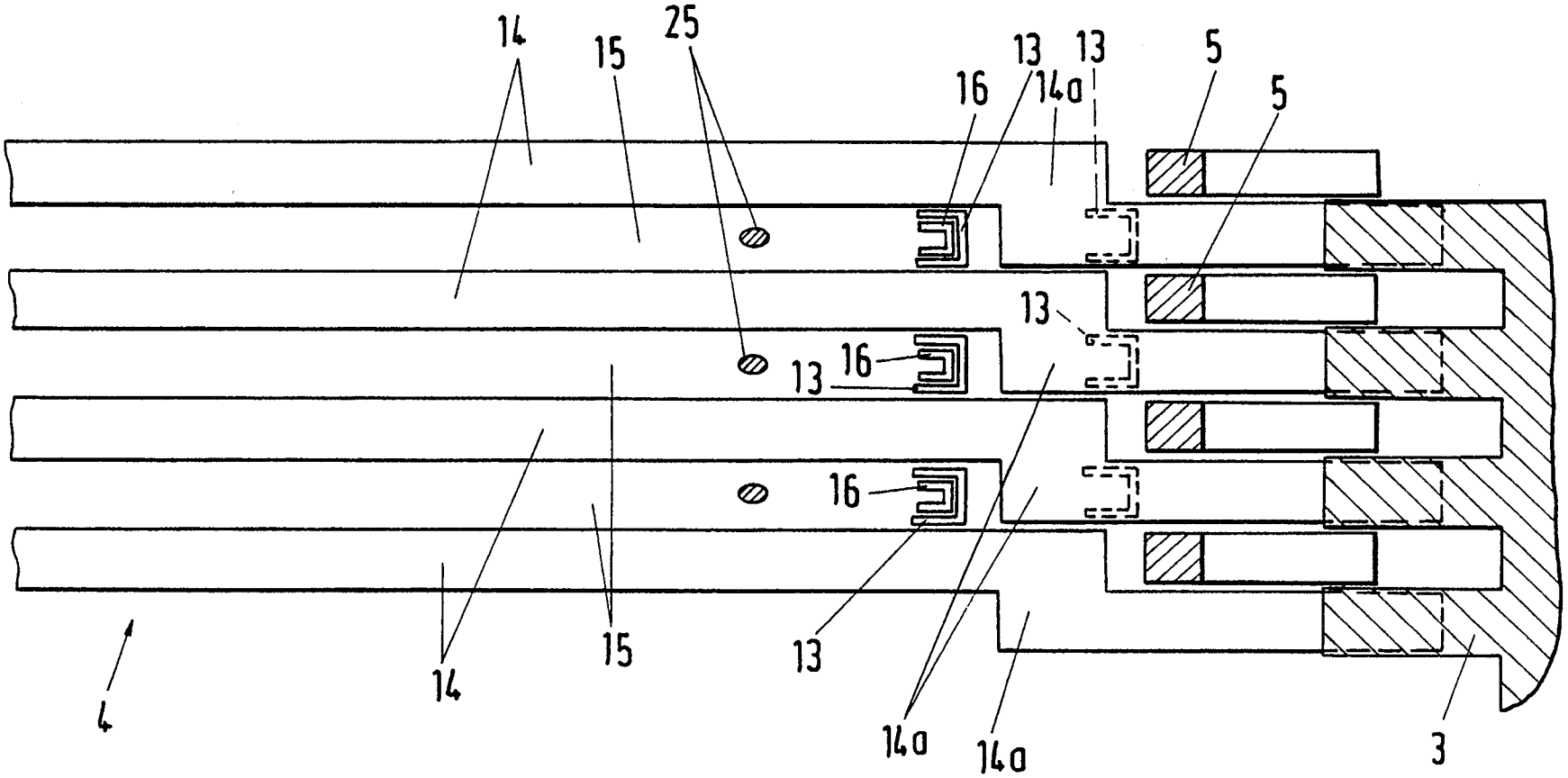
FIG. 4 shows in a view corresponding to FIG. 2 of an alternative embodiment of the present invention.

In the variant represented in FIG. 4 identical components are indicated with identical reference numerals with respect to the device described above. In deviation from the first variant, the fingers 16 of the transferring support 17 of the second variant as well as the fingers 13 of the separating support 7 have a U-shaped cross-section. In this manner the fingers 16 of the transferring support 17 can be inserted into the fingers 13 of the separating support 7. All of the supports 7, 17, 22, 23 in this variant are arranged above, respectively, below the slots 15 of the table 4. Within the area of the horizontal displacement of the separating support 7, the table 4 is provided with additional narrow tracks 14*a* which in this area are positioned between the tracks 14.

The present invention is, of course, in no way restricted to the specific disclosure of the specification and drawings, but also encompasses any modifications within the scope of the appended claims.

What we claim:

1. A method for producing defined stacks of folded and unfolded sheets or sheet-type objects, said method comprising the steps of:

individually feeding sheets to a horizontal surface;

placing each sheet on edge onto the horizontal surface;

separating the sheets into individual stacks with a separating support by forming a first separating plane defining the beginning of the stack and forming a second separating plane defining the end of the stack by sequentially inserting the separating support transverse to the longitudinal extension of the horizontal surface between the sheets placed on edge on the horizontal surface;

advancing the separating support parallel to the horizontal surface at the stack forming velocity;

introducing at the first separating plane a first support and at the second separating plane a second support;

introducing a transferring support at the first separating plane and subsequently at the second separating plane before introducing the first and second supports for maintaining said first and said second separating planes; and moving said transferring support along said horizontal surface into said first separating plane for transferring the beginning of the stack to said first support and subsequently moving said transferring support into said second separating plane for transferring the end of the stack to said second support.

2. A method according to claim 1, further comprising the step of introducing the separating support with a pre-stressed device.

3. A method according to claim 2, further comprising the step of releasing the pre-stressed device by activating a locking pawl.

4. A method according to claim 1, further comprising the step of advancing parallel to the horizontal surface the second support faster than the first support.

5. A method according to claim 1, further comprising the step of advancing the transferring support at the stack forming velocity during introduction into the first and the second separating planes, while the separating support is also advanced at the stack forming velocity.

6. A method according to claim 1, further comprising the step of advancing the first and the second supports at the stack forming velocity during introduction into the first and the second separation planes, while the transferring support is also advanced at the stack forming velocity.

7. A method according to claim 1, further comprising the step of actuating the separating support, the transferring support, and the first and second supports with respective operating cylinders.

8. A device for producing defined stacks of folded and unfolded sheets or sheet-type objects, said device comprising:

a horizontal table;

a feeding device for individually feeding sheets to said horizontal table and placing the sheets on edge onto said horizontal table;

a separating support displaceable in a longitudinal direction of said horizontal table for separating the sheets into individual stacks by forming a separating plane, said separating support vertically movable for complete insertion between the sheets;

at least two further supports independently displaceable relative to said separating support in the longitudinal direction of said horizontal table, said further supports vertically movable for complete insertion between the sheets and serving to remove a finished stack; and a transferring support displaceable in the longitudinal direction of said horizontal table to coincide respectively with said separating plane of said separating support, with a plane of said first support, and with a plane of said second support.

9. A device according to claim 8, wherein said further supports comprise a relative guide for horizontally moving said further supports relative to one another.

10. A device according to claim 9, further comprising a common horizontal guide to which said further supports together with said relative guide are slidably connected.

11. A device according to claim 8, further comprising a pressure cylinder with a piston, said piston connected to said separating support.

12. A device according to claim 11, wherein said separating support comprises a locking pawl for locking said separating support in an initial position thereof.

13. A device according to claim 8, wherein said transferring support is connected to said device on a side of said horizontal table opposite to said separating support and said further supports.

14. A device according to claim 8, further comprising an operating cylinder connected to said transferring support for displacing said transferring support in the longitudinal direction of said horizontal table.

15. A Device according to claim 8, wherein said separating support, said further supports, and said transferring support each are in the form of a rake with a plurality of parallel fingers.

16. A device according to claim 15, wherein said table has a plurality of longitudinally extending slots with longitudinal tracks therebetween.

17. A device according to claim 16, wherein said fingers of said further supports and said transferring support are arranged within the area of said slots, and wherein said fingers of said separating support are arranged within the area of said tracks of said horizontal table.

18. A device according to claim 15, wherein said fingers of said transferring support have a U-shaped cross-section, with the open side of said U-shaped cross-section facing said feeding device.

19. A device according to claim 8, wherein said horizontal table comprises adjusting elements for adjusting the height of said table.

20. A device according to claim 8, further comprising adjusting members for adjusting the width of said horizontal table, of said separating support, of said transferring support, and of said further supports.

21. A device according to claim 8, further comprising an operating cylinder connected to said separating support for displacing said separating support in the longitudinal direction of said horizontal table.

* * * * *